US008313641B2

(12) United States Patent
Kanazirev et al.

(10) Patent No.: US 8,313,641 B2
(45) Date of Patent: Nov. 20, 2012

(54) ADSORBENT FOR FEED AND PRODUCTS PURIFICATION IN A REFORMING PROCESS

(75) Inventors: Vladislav I. Kanazirev, Arlington Heights, IL (US); Jayant K. Gorawara, Buffalo Grove, IL (US); Dana K. Sullivan, Mount Prospect, IL (US); Richard R. Rosin, Glencoe, IL (US)

(73) Assignee: UOP LLC, Des Plaines, IL (US)

( * ) Notice: Subject to any disclaimer, the term of this patent is extended or adjusted under 35 U.S.C. 154(b) by 22 days.

(21) Appl. No.: 13/151,470

(22) Filed: Jun. 2, 2011

(65) Prior Publication Data

US 2012/0000825 A1 Jan. 5, 2012

Related U.S. Application Data

(60) Provisional application No. 61/359,915, filed on Jun. 30, 2010.

(51) Int. Cl.
*C10G 35/04* (2006.01)
*C10G 17/00* (2006.01)

(52) U.S. Cl. ..... 208/133; 208/134; 208/141; 208/213; 208/208 R

(58) Field of Classification Search ..... 585/133, 585/134, 141, 213, 208 R
See application file for complete search history.

(56) References Cited

U.S. PATENT DOCUMENTS

| | | | |
|---|---|---|---|
| 2,915,365 | A | 12/1959 | Saussol |
| 4,028,223 | A | 6/1977 | Hayes et al. |
| 4,087,383 | A | 5/1978 | Gernand et al. |
| 4,155,835 | A | 5/1979 | Antal |
| 4,592,829 | A | 6/1986 | Eberly, Jr. |
| 4,695,366 | A | 9/1987 | Miller et al. |
| 4,863,894 | A | 9/1989 | Chinchen et al. |
| 5,003,118 | A | 3/1991 | Low et al. |
| 5,227,351 | A | 7/1993 | Gasper-Galvin et al. |
| 5,663,466 | A | 9/1997 | Rice et al. |
| 6,033,461 | A | 3/2000 | Yang et al. |
| 6,224,840 | B1 | 5/2001 | Kim et al. |
| 6,960,700 | B1 | 11/2005 | Sethna et al. |
| 7,102,038 | B2 | 9/2006 | Murray et al. |
| 7,291,259 | B2 | 11/2007 | Gupta et al. |
| 7,618,558 | B2 | 11/2009 | Nielsen |
| 7,906,088 | B2 | 3/2011 | Kanazirev et al. |
| 2006/0261011 | A1 | 11/2006 | Kanazirev et al. |
| 2008/0041227 | A1 | 2/2008 | Mulvaney, III et al. |
| 2008/0119358 | A1 | 5/2008 | Kanazirev et al. |
| 2008/0173586 | A1 | 7/2008 | Kanazirev et al. |
| 2008/0271602 | A1 | 11/2008 | Tatarchuk et al. |
| 2008/0286173 | A1 | 11/2008 | Shecterle |
| 2008/0287724 | A1 | 11/2008 | Shecterle |
| 2008/0289496 | A1 | 11/2008 | Poshusta et al. |
| 2009/0155148 | A1 | 6/2009 | Kanazirev |
| 2009/0266232 | A1 | 10/2009 | Nakamura et al. |
| 2010/0326886 | A1 | 12/2010 | Kanazirev et al. |
| 2012/0004480 | A1 | 1/2012 | Kanazirev et al. |

FOREIGN PATENT DOCUMENTS

| | | | |
|---|---|---|---|
| EP | 0865814 | A2 | 9/1998 |
| JP | 10235185 | A | 9/1998 |

OTHER PUBLICATIONS

Quinn, "Removal of Arsine from Synthesis Gas Using a Copper on Carbon Adsorbent", Ind. Eng. Chem. Res. 2006, 45, 6272-6278.
U.S. Appl. No. 13/218,031, filed Aug. 25, 2011, Vladislav I. Kanazirev et al.
Brazlauskas, "Synthesis and Properties of CuO/Zeolite Sandwich Type Adsorbent-Catalysts", Chin J Catal, 2008, 29(1): 25-30.
Buelna, "Preparation of spherical alumina and copper oxide coated alumina sorbents by improved sol-gel granulation process", Microporous and Mesoporous Materials 42 (2001) 67-76.
Iretskaya, "Promoting Effect of Chloride on the SO2 Adsorption Capacity and Adsorption Rate of Alumina-Supported Copper Oxide Adsorbents: Thermogravimetric and Infrared Studies", J. Phys. Chem. B 2003, 107, 4955-4962.
Li, "Metal Loaded Zeolite Adsorbents for Phosphine Removal", Ind. Eng. Chem. Res. 2008, 47, 1501-1505.
Wang, "Sol-Gel-Derived Alumina-Supported Copper Oxide Sorbent for Flue Gas Desulfurization", Ind. Eng. Chem. Res. 1998, 37, 4675-4681.

*Primary Examiner* — Thuan D Dang
(74) *Attorney, Agent, or Firm* — Mark Goldberg

(57) ABSTRACT

The service life and deactivation rate of a reforming catalyst is improved through use of a new sulfur guard bed containing a chloride additive. This sulfur guard bed, which contains supported CuO material having an increased resistance to reduction, shows such improvement. Thus, the danger of run-away reduction followed by a massive release of water causing process upsets in a catalytic reforming process is practically eliminated. The fact that the guard bed material preserves the active metal phase—copper in an active (oxide) form is an important advantage leading to very low sulfur content in the product stream. The sulfur capacity per unit weight of sorbent is also significantly increased, making this sorbent a superior cost effective sulfur guard product.

9 Claims, No Drawings

ADSORBENT FOR FEED AND PRODUCTS PURIFICATION IN A REFORMING PROCESS

CROSS-REFERENCE TO RELATED APPLICATION

This application claims priority from Provisional Application No. 61/359,915 filed Jun. 30, 2010, the contents of which are hereby incorporated by reference.

BACKGROUND OF THE INVENTION

The present invention involves an improvement to the feed and product in a naphtha reforming process. In particular the present invention provides an adsorbent that is effective for trace sulfur removal for feeds to naphtha reforming units as well as product streams from such units.

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Growing demand for high-purity aromatics as petrochemical intermediates also is a driving force for the upgrading of naphtha.

Catalytic reforming is a major focus, as this process generally supplies 30-40% or more of the gasoline pool and is the principal source of benzene, toluene and xylenes for chemical syntheses. Increased reforming severity often is accompanied by a reduction in reforming pressure in order to maintain yield of gasoline-range product from the reforming unit. Both higher severity and lower pressure promote the formation of olefins in reforming, and the 1-2+% of olefins in modern reformats contribute to undesirable gum and high endpoint in gasoline product and to particularly troublesome impurities in recovered high-purity aromatics streams.

Catalytic reforming catalysts are sensitive to sulfur compounds that may be present in the feedstock at levels of about 10 parts per million (ppm). Optimally, it is desired to reduce the level of sulfur compound contamination to levels of about 1 to 0.1 ppm.

Guard beds with supported copper oxide (CuO) have been used for feed purification in catalytic reforming units. Unfortunately, the CuO reduces in the, at the typical operating temperatures for the liquids being treated. Typically in prior art systems, the reduction of CuO occurs rapidly, and large amounts of water are produced. The excessive moisture is disadvantageous to the operation of the catalytic reforming catalyst, causing undesirable side reactions. In addition, there is the undesired exotherm.

Copper containing materials are widely used in industry as catalysts and sorbents. The water shift reaction in which carbon monoxide is reacted in presence of steam to make carbon dioxide and hydrogen as well as the synthesis of methanol and higher alcohols are among the most practiced catalytic processes nowadays. Both processes employ copper oxide based mixed oxide catalysts.

Copper-containing sorbents play a major role in the removal of contaminants, such as sulfur compounds and metal hydrides, from gas and liquid streams. One new use for such sorbents involves the on-board reforming of gasoline to produce hydrogen for polymer electrolyte fuel cells (PEFC).

The hydrogen feed to a PEFC must be purified to less than 50 parts per billion parts volume of hydrogen sulfide due to the deleterious effects to the fuel cell of exposure to sulfur compounds.

Copper oxide (CuO) normally is subject to reduction reactions upon being heated but it also can be reduced even at ambient temperatures in ultraviolet light or in the presence of photochemically generated atomic hydrogen.

The use of CuO on a support that can be reduced at relatively low temperatures is considered to be an asset for some applications where it is important to preserve high dispersion of the copper metal. According to U.S. Pat. No. 4,863,894, highly dispersed copper metal particles are produced when co-precipitated copper-zinc-aluminum basic carbonates are reduced with molecular hydrogen without preliminary heating of the carbonates to temperatures above 200° C. to produce the mixed oxides. However, easily reducible CuO is disadvantageous in some important applications, such as the removal of hydrogen sulfide from gas and liquid streams when very low residual concentration of $H_2S$ in the product is required The residual $H_2S$ concentration in the product gas is much higher (which is undesirable) when the CuO reduces to Cu metal in the course of the process since reaction (1) is less favored than the CuO sulfidation to CuS.

$$2Cu+H_2S=Cu_2S+H_2 \quad (1)$$

The known approaches to reduce the reducibility of the supported CuO materials are based on combinations with other metal oxides such as $Cr_2O_3$. The disadvantages of the approach of using several metal oxides are that it complicates the manufacturing of the sorbent because of the need of additional components, production steps and high temperature to prepare the mixed oxides phase. As a result, the surface area and dispersion of the active component strongly diminish, which leads to performance loss. Moreover, the admixed oxides are more expensive than the basic CuO component which leads to an increase in the sorbent's overall production cost.

The present invention comprises a new method to improve feed purification in a catalytic naphtha reforming process by using a supported CuO adsorbent which contains chloride as a means to decrease the tendency of CuO to be reduced to low valent state, especially Cu metal. Surprisingly, it has now been found that introducing chloride either in the basic copper carbonate, which serves as CuO precursor, or into the intermediate CuO-alumina adsorbent leads to material having improved resistance to reduction in catalytic reforming processes.

SUMMARY OF THE INVENTION

The present invention provides an improved catalytic naphtha reforming process that consists of using a sulfur removal guard bed that contains supported CuO material having an increased resistance to reduction. As a result of the use of this guard bed, the deactivation rate and the service life of the reforming catalyst significantly improves. This invention employs a supported CuO material whereby the resistance of the CuO phase towards reduction has been significantly increased. Thus, the danger of run-away reduction followed by a massive release of water and process upset over the period of the water release of the reforming catalyst is strongly diminished. Another important benefit is that the guard bed material preserves the active metal phase—copper in an active (oxide) form which is needed for complete sulfur removal. This advantage will result in a significant increase in sulfur capacity per unit weight of sorbent making this sorbent a more cost effective sulfur guard product. Finally, an important advantage is that the exothermic reaction of reduction of CuO to copper metal is avoided and even under strong reducing conditions, the material of the present invention will reduce mainly to cuprous oxide instead of to copper metal which is the case with prior art copper based sulfur adsorbents. Yet another advantage of the present invention is the ability to treat mixed phase streams.

The improved sulfur guard adsorbents of the present invention contain CuO supported on alumina wherein small amounts of an inorganic halide, such as sodium chloride is added to the carbonate precursor of CuO or to the intermediate adsorbent before the final thermal treatment (calcination) for a sufficient time at a temperature in the range 280° to 500° C. These reduction resistant sorbents show significant benefits in the removal of sulfur and other contaminants from gas and liquid streams. These sorbents are particularly useful in applications where the sorbents are not regenerated. Sulfur contaminants that are removed include hydrogen sulfide, light mercaptans, sulfides, disulfides, thiophenes and other organic sulfides and COS.

DETAILED DESCRIPTION OF THE INVENTION

Reforming, may be carried out in two or more fixed-bed reactors in sequence (including cyclic or swing-reactor units) or in moving-bed reactors with continuous catalyst regeneration. Reforming operating conditions include a pressure of from about atmospheric to 60 atmospheres (absolute), with the preferred range being from atmospheric to 20 atmospheres and a pressure of below 10 atmospheres being especially preferred. Hydrogen is supplied to the reforming zone in an amount sufficient to correspond to a ratio of from about 0.1 to 10 moles of hydrogen per mole of hydrocarbon feedstock. The operating temperature generally is in the range of 257° to 567° C. The volume of the contained reforming catalyst corresponds to a liquid hourly space velocity of from about 0.5 to 40 $hr^{-1}$.

The normal naphtha feedstock to the preferred reforming embodiment of the process combination is a mixture comprising paraffins, naphthenes, and aromatics, and may comprise small amounts of olefins, boiling within the gasoline (naphtha) range of from about 49° to about 193° C. (120° to 380° F.). Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point typically from 0° to 100° C. and a 95%-distilled point of from about 160° to 230° C.; more usually, the initial boiling range is from about 40° to 80° C. and the 95%-distilled point from about 175° to 200° C. Generally, the naphtha feedstock contains less than about 30 mass-% $C_6$ and lighter hydrocarbons, and usually less than about 20 mass-% $C_6$—, since the objectives of gasoline reformulation and benzene reduction are more effectively accomplished by processing higher-boiling hydrocarbons. $C_6$ and lighter hydrocarbons generally are upgraded more effectively by isomerization. The total paraffin content of the naphtha generally ranges between about 20 and 99 mass-%, with a more usual range for straight-run naphtha derived from crude oil being from about 50 to 80 mass-%.

The naphtha feedstock generally contains small amounts of sulfur compounds amounting to less than 10 parts per million (ppm) on an elemental basis. The types of sulfur compounds removed include hydrogen sulfide, mercaptans, disulfides, sulfides and thiophenes. The naphtha feedstock needs to be treated to convert and remove sulfur contaminants. Optimally, the pretreating step will provide the preferred reforming step with a hydrocarbon feedstock having low sulfur levels disclosed in the prior art as desirable, e.g., 1 ppm to 0.1 ppm (100 ppb).

The reforming catalyst conveniently is a dual-function composite containing a metallic hydrogenation-dehydrogenation component on a refractory support which provides acid sites for cracking, isomerization, and cyclization. The hydrogenation-dehydrogenation component comprises a supported platinum-group metal component, with a platinum component being preferred. The platinum may exist within the catalyst as a compound, in chemical combination with one or more other ingredients of the catalytic composite, or as an elemental metal. Best results are obtained when substantially all of the platinum exists in the catalytic composite in a reduced state. The catalyst may contain other metal components known to modify the effect of the preferred platinum component, including Group IVA (14) metals, other Group VII (8-10) metals, rhenium, indium, gallium, zinc, and mixtures thereof, with a tin component being preferred.

Guard beds with supported copper oxide (CuO) are often used for feed purification. Unfortunately, the CuO reduces in the presence of the hydrogen, at the typical operating temperatures, which causes conversion of CuO to $Cu_2O$ and even to Cu metal, thereby producing water as reaction product. Typically the reduction of CuO occurs rapidly, and large amounts of water are produced. The excessive moisture could even overcome the down stream feed dryers and water leakage from the driers will cause irreversible catalyst deactivation. In addition, there are safety issues due to the high exotherm during the reduction of CuO and the presence of hydrogen.

This invention employs a supported CuO material whereby the resistance of the CuO phase towards reduction has been significantly increased. Thus, the danger of run-away reduction followed by a massive release of water, deactivation of catalyst and dangerous exotherms is strongly diminished. Finally another important benefit is that the guard bed material preserves the active metal phase—copper in an active (oxide) form which is needed for complete sulfur removal. This advantage will result in a significant increase in sulfur capacity per unit weight of sorbent making this sorbent a more cost effective sulfur guard product.

Basic copper carbonates such as $CuCO_3.Cu(OH)_2$ can be produced by precipitation of copper salts, such as $Cu(NO)_3$, $CuSO_4$ and $CuCl_2$, with sodium carbonate. Depending on the conditions used, and especially on washing the resulting precipitate, the final material may contain some residual product from the precipitation process. In the case of the $CuCl_2$ raw material, sodium chloride is a side product of the precipitation process. It has been determined that a commercially available basic copper carbonate that had both residual chloride and sodium, exhibited lower stability towards heating and improved resistance towards reduction than another commercial BCC that was practically chloride-free.

In some embodiments of the present invention, agglomerates are formed comprising a support material such as alumina, copper oxide from a precursor such as basic copper carbonate (BCC) and halide salts. The alumina is typically present in the form of transition alumina which comprises a mixture of poorly crystalline alumina phases such as "rho", "chi" and "pseudo gamma" aluminas which are capable of quick rehydration and can retain substantial amount of water in a reactive form. An aluminum hydroxide $Al(OH)_3$, such as Gibbsite, is a source for preparation of transition alumina.

The typical industrial process for production of transition alumina includes milling Gibbsite to 1 to 20 microns particle size followed by flash calcination for a short contact time as described in the patent literature such as in U.S. Pat. No. 2,915,365. Amorphous aluminum hydroxide and other naturally found mineral crystalline hydroxides e.g., Bayerite and Nordstrandite or monoxide hydroxides (AlOOH) such as Boehmite and Diaspore can be also used as a source of transition alumina. In the experiments done in reduction to practice of the present invention, the transition alumina was supplied by the UOP LLC plant in Baton Rouge, La. The BET surface area of this transition alumina material is about 300 $m^2/g$ and the average pore diameter is about 30 Angstroms as determined by nitrogen adsorption.

Typically a solid oxysalt of a transitional metal is used as a component of the composite material. For the purpose of the examples presented of the present invention, we used basic copper carbonate (BCC), $CuCO_3Cu(OH)_2$ which is a synthetic form of the mineral malachite, produced by Phibro Tech, Ridgefield Park, N.J. The particle size of the BCC particles is approximately in the range of that of the transition alumina—1 to 20 microns. Another useful oxysalt would be Azurite—$Cu_3(CO_3)_2$ $(OH)_2$. Generally, oxysalts of copper, nickel, iron, manganese, cobalt, zinc or a mixture of elements can be successfully used where copper is the main component.

The preferred inorganic halides are sodium chloride, potassium chloride or mixtures thereof. Bromide salts are also effective. The chloride content in the copper oxide sorbent may range from 0.05 to 2.5 mass-% and preferably is from 0.3 to 1.2 mass-%. Various forms of basic copper carbonate may be used with a preferred form being synthetic malachite, $CuCO_3Cu(OH)_2$.

The copper oxide sorbent that contains the halide salt exhibits a higher resistance to reduction by hydrocarbons and hydrogen than does a similar sorbent that is made without the halide salt. This feature is useful for feed purification in a benzene saturation process, especially for the removal of sulfur compounds In addition, the sorbent is useful in applications where the adsorbent is not regenerated. The removal of $H_2S$, light mercaptans, sulfides, disulfides, thiophenes and other organic sulfur compounds and carbonyl sulfide (COS) is an advantageous use of the adsorbent. Mercury can also be removed by this adsorbent.

Table 1 lists characteristic composition data of three different basic copper carbonate powder samples designated as Samples 1, 2 and 3.

TABLE 1

| Composition, Mass-% | Sample Number 1 | 2 | 3 |
|---|---|---|---|
| Copper | 55.9 | 55.4 | 54.2 |
| Carbon | 5.0 | 5.1 | 5.1 |
| Hydrogen | 1.3 | 1.2 | 1.2 |
| Sodium | 0.23 | 0.51 | 0.51 |
| Chloride | 0.01 | 0.32 | 0.28 |
| Sulfate | 0.06 | 0.01 | 0.02 |

All three samples were subjected to thermal treatment in nitrogen in a microbalance followed by reduction in a 5% $H_2$-95% $N_2$ stream. As the thermogravimetric (TG) analysis showed, chloride-containing BCC Samples 2 and 3 decompose to CuO at about 40° to 50° C. lower temperatures than Sample 1. On the other hand, the latter sample was found to reduce more easily in presence of $H_2$ than the Cl-containing samples. The reduction process completed with Sample 1 at 80° to 90° C. lower temperature than in the case of the Cl-containing Samples 2 and 3.

This reduction behavior was confirmed by preparing a mechanical mixture of NaCl and the Cl—free Sample 1 and then subjecting the mixture to a TG decomposition reduction test.

In particular, 25 mg of NaCl reagent was intimately mixed with about 980 mg BCC (sample 1). The mixture was homogenized for about 2 minutes using an agate mortar and pestle prior to TG measurements.

It was found that the addition of NaCl makes Sample 1 decompose more easily but also makes it resist reduction to a higher extent than in the case where no chloride is present. The observed effect of NaCl addition is definitely beyond the range of experimental error.

The exact mechanism of the chloride action is unknown at this point. We hypothesize that the salt additive may incorporate in some extent in the structure of the source BCC weakening it and making it more susceptible to decomposition. On the other hand, the copper oxide produced upon thermal decomposition of BCC now contains an extraneous species that may affect key elements of the metal oxide reduction process such as $H_2$ adsorption and activation and penetration of the reduction front throughout the CuO particle as well. We do not wish to favor any particular theory of Cl action at this point.

The series of experiments in which NaCl was added was conducted in a Perkin Elmer TGA-1 microbalance operated in a helium flow. The sample size was typically 8-10 mg. Both decomposition and reduction runs were conducted with one sample at a heating rate of about 25° C./min followed by short hold at 400° C. After cooling to about ambient temperature, 1.5% $H_2$—balance He—$N_2$ mixture was used as a reduction agent.

Table 2 presents data on several samples produced by mixing different amounts of NaCl or KCl powder to the BCC Sample 1 listed in Table 1.

TABLE 2

| Sample | Basic Cu carbonate, (g) | NaCl (g) | KCl (g) | Pre-treatment temperature, ° C. | Characteristic temperature, ° C. BCC decomposition* | CuO reduction** |
|---|---|---|---|---|---|---|
| 1 | #1 only | 0 | 0 | 400 | 335 | 256 |
| 2 | 9.908 | 0.103 | 0 | 400 | 296 | 352 |
| 3 | 9.797 | 0.201 | 0 | 400 | 285 | 368 |
| 4 | 9.809 | 0.318 | 0 | 400 | 278 | 369 |
| 5 | 9.939 | 0 | 0.150 | 400 | 282 | 346 |
| 6 | 9.878 | 0 | 0.257 | 400 | 279 | 378 |
| 7 | 0.981 | 0 | 0.400 | 400 | 279 | 382 |
| 8 | #1 only | 0 | 0 | 500 | 333 | 310 |
| 9 | 9.797 | 0.201 | 0 | 500 | 282 | 386 |

*Temperature at which 20 mass-% sample weight is lost due to BCC decomposition

**Temperature at which 5% sample weight is lost due to CuO reduction

The data also shows that both NaCl and KCl are effective as a source of Cl. Adding up to 1% Cl by weight affects strongly both decomposition temperature of BCC and the reduction temperature of the resulting CuO. It can be also seen that the combination of a thermal treatment at a temperature which is higher than the temperature needed for complete BCC decomposition and Cl addition leads to the most pronounced effect on CuO resistance towards reduction—compare Samples 3, 8 and 9 in Table 2.

Finally, the materials produced by conodulizing the CuO precursor—BCC with alumina followed by curing and activation retain the property of the basic Cu carbonate used as a feed. The BCC that is more resistant to reduction yielded a CuO—alumina sorbent which was difficult to reduce.

The following example illustrates one particular way of practicing this invention with respect of CuO—alumina composites: About 45 mass-% basic copper carbonate (BCC) and about 55 mass-% transition alumina (TA) produced by flash calcination were used to obtain 7×14 mesh beads by rotating the powder mixture in a commercial pan nodulizer while spraying with water. About 1000 g of the green beads were then additionally sprayed with about 40 cc 10% NaCl solution in a laboratory rotating pan followed by activation at about 400° C. The sample was then subjected to thermal treatment & reduction in the Perkin Elmer TGA apparatus as described earlier. Table 3 summarizes the results to show the increased resistance towards reduction of the NaCl sprayed sample.

TABLE 3

| | | Characteristic temperature of TGA analysis, ° C. | |
|---|---|---|---|
| Sample | Preparation condition | BCC decomposition* | CuO reduction** |
| 10 | Nontreated | 341 | 293 |
| 11 | Nontreated + activation | n/a | 302 |
| 12 | NaCl treated | 328 | 341 |
| 13 | NaCl treated + activation | n/a | 352 |

*Temperature at which 20 mass-% sample weight is lost due to BCC decomposition
**Temperature at which 5% sample weight is lost due to CuO reduction A cost-effective way to practice the invention is to leave more NaCl impurity in the basic Cu carbonate during the production. This can be done, for example, by modifying the procedure for the washing of the precipitated product. One can then use this modified BCC precursor to produce the sorbents according to our invention.

Another way to practice the invention is to mix solid chloride and metal oxide precursor (carbonate in this case) and to subject the mixture to calcinations to achieve conversion to oxide. Prior to the calcinations, the mixture can be co-formed with a carrier such as porous alumina. The formation process can be done by extrusion, pressing pellets or nodulizing in a pan or drum nodulizer.

Still another promising way to practice the invention is to co-nodulize metal oxide precursor and alumina by using a NaCl solution as a nodulizing liquid. The final product containing reduction resistant metal (copper) oxide would then be produced after proper curing and thermal activation.

It has been found that the adsorbents of the present invention result in 50% less water evolution and that the water that is produced is delayed. The adsorbent has a 25% higher capacity for sulfur as compared to previously used products. This material has a higher surface area and better pore distribution which leads to enhanced metal utilization. In addition, it was found that the copper oxide adsorbents were more active for sulfur removal at temperatures below 175° C.

We found that pilot plant testing of a commercial naphtha feed comparing a prior art copper oxide product with the difficult to reduce adsorbent of the present invention showed that the prior art product had a much higher water evolution during start-up of the adsorbent bed at 160° C. In our testing, after dry down of the system with nitrogen prior to start-up, liquid naphtha feed was introduced into the reactor after about 420 minutes. Dew point measurements in the liquid effluent stream indicated the water content of the stream. Since the maximum dew point of the instrument that was used was 20° C., the water concentration in the standard, prior art material exceeded the scale after approximately 1500 minutes. The dew point of the difficult to reduce material was about −5° C. and was not reached until after about 3000 minutes.

In another set of tests, an isooctane feed was tested at an adsorbent bed temperature of 110° C. This feed contained equal proportions of propyl mercaptans, dimethyl sulfide and thiophene. The difficult to reduce material showed that there was lower water evolution (causing less of a process upset) and there was a higher capacity for sulfur compounds resulting in longer run lengths.

Representative samples of the difficult to reduce CuO containing material produced similarly to Sample 13 highlighted in Table 3 and another material that has not been treated with chloride (Sample 11 in Table 3) were tested with a commercial naphtha feed for about 110 hours at the conditions described in paragraph 0040. Subsequently, a spent sample from the inlet portion of the adsorbent bed was taken and analyzed by X-ray diffraction. The material that has not been treated with chloride contained exclusively Cu metal as the Cu species present while the difficult to reduce material had Cu2O-type species as the major Cu crystalline phase. Some CuO species were also present. Only minor amount of Cu metal could be detected in the difficult to reduce material.

The invention claimed is:

1. A process for catalytic reforming a naphtha feed stream containing sulfur-compound poisons for a reforming catalyst comprising steps:

1) sending said feed stream through a sulfur guard bed to remove said sulfur compounds from the naphtha feed stream to produce a naphtha stream having a reduced sulfur content, wherein said sulfur guard bed comprises sorbents comprising CuO supported on an alumina substrate and about 0.001 to 2.5% by weight of a chloride additive, wherein said sulfur sorbents are prepared by steps:

i) mixing basic copper carbonates $CuCO_3.Cu(OH)_2$, alumina, and water to form beads, ii) adding NaCl or KCl to the beads of step (i);

iii) activating the beads of step (ii) by heat treating at a temperature ranging from 280 to 500° C. to form said sorbent used for step (1); and 2) reforming said naphtha stream having a reduced sulfur content of step (1) in the presence of said reforming catalyst to produce a reformed product.

2. The process of claim 1 wherein said sulfur guard bed comprises about 10 to 85% by weight CuO.

3. The process of claim 1 wherein said sulfur guard bed comprises about 20 to 60% by weight CuO.

4. The process of claim 1 wherein said sulfur guard bed comprises about 30 to 50% by weight CuO.

5. The process of claim 1 wherein said sulfur guard bed further comprises a metal oxide in addition to said CuO.

6. The process of claim 1 wherein said sulfur guard bed comprises 0.3 to 1.0 weight percent of said chloride.

7. The process of claim 1 wherein said sulfur compounds are selected from the group consisting of mercaptans, sulfides, disulfides, thiophenes, carbonyl sulfide, hydrogen sulfide and mixtures thereof.

8. The process of claim 1 wherein said chloride additive provides at least a 25% reduction in water evolution during start-up of the sulfur guard bed upstream of said catalytic reforming catalyst when compared to a sulfur guard bed that does not contain said chloride additive.

9. The process of claim 1 wherein said chloride additive provides at least a 40% reduction in water evolution during start-up of the sulfur guard bed upstream of catalytic reforming catalyst when compared to a sulfur guard bed that does not contain said chloride additive.

* * * * *